United States Patent [19]

Chappel

[11] Patent Number: 4,812,798

[45] Date of Patent: Mar. 14, 1989

[54] ELECTRIC TRANSFORMER FOR MICROWAVE OVENS

[75] Inventor: Bernard Chappel, Albertville, France

[73] Assignee: Societe Pour L'Application De L'Optique et de L'Electronique a la Recherche et a L'Automatisation Optelec, Albertville, France

[21] Appl. No.: 191,563

[22] Filed: May 9, 1988

[30] Foreign Application Priority Data

May 11, 1987 [FR] France ..... 87 06927

[51] Int. Cl.[4] ..... H01F 27/02; H01F 27/30

[52] U.S. Cl. ..... 336/98; 219/10.55 B; 336/165; 336/170; 336/192; 336/198

[58] Field of Search ..... 219/10.55 B; 336/90, 336/98, 160, 165, 192, 198, 170, 178, 208

[56] References Cited

U.S. PATENT DOCUMENTS

| | | | |
|---|---|---|---|
| 2,858,514 | 10/1958 | Henderson et al. | 336/198 X |
| 3,605,055 | 9/1971 | Grady | 336/208 |
| 3,750,072 | 7/1973 | Weiner | 336/208 |
| 3,909,761 | 9/1975 | Miles | 336/208 |
| 4,405,913 | 9/1983 | Finkbeiner | 336/98 |

FOREIGN PATENT DOCUMENTS 8633338 3/1987 Fed. Rep. of Germany .

*Primary Examiner*—Thomas J. Kozma
*Attorney, Agent, or Firm*—Ratner & Prestia

[57] ABSTRACT

The invention provides an electric transformer for microwave ovens including a conventional magnetic circuit with three columns, and electric circuits insulated by carcases and covers made from an insulating material. The secondary carcase forms a particular housing for the secondary heating winding so that the secondary high voltage winding and the secondary heating winding are partially superimposed. Thus an excellent electric insulation is provided without loss of space.

10 Claims, 6 Drawing Sheets

ELECTRIC TRANSFORMER FOR MICROWAVE OVENS

BACKGROUND OF THE INVENTION

1. Field of the Invention

The present invention relates to electric transformers for supplying the power circuits of microwave ovens with electric power. These transformers include a primary electric winding, in the form of a coil, the two ends of the winding wire being connected electrically to tags for connection to the mains supply network. A secondary high voltage electric winding is formed of a coiled electric conductor a first end of which is connected electrically to the transformer magnetic circuit and to the ground of the microwave oven, and the other end of which is connected electrically to a high voltage output tag for connection to the high voltage electric elements of the microwave oven for supplying them with power. The transformer further includes a secondary electric heating winding formed of a coiled conductor, with a small number of turns, the two ends of the heating conductor being provided with tags for connection to the filament heating electric circuit of the magnetron of the microwave oven. The magnetic circuit of the transformer includes two lateral columns and a central column all three connected together by end cross pieces. An intermediate magnetic shunt partially loops the magnetic circuit between the lateral columns and the central column, deflecting a part of the magnetic flow between the primary electric winding and the secondary high voltage electric winding.

The power usually delivered by such a transformer ranges between 200 and 1500 W, so that it is a question of low power transformers. The primary supply voltage is generally 110–240 V. The high voltage output voltage is generally about 2300 V and must have a special waveform which the magnetic circuit with a special magnetic shunt confers thereon.

It is thus indispensable to provide very efficient electric insulation, able to withstand a voltage of about 10 kV without breakdown between the different electric windings and between the electric windings and the magnetic circuit.

2. Description of the Prior Art

The electric insulation is generally provided by insulating foils folded and wrapped adequately about the windings and between the windings and the magnetic circuit. This insulating technique is described for example in the patent U.S. Pat. No. 2,858,514. Thus, all the transformers for microwave ovens at present on the market include such a type of electric insulation. The operations for providing such insulations are particularly time consuming and tedious, and substantially increase the production cost. These operations are necessarily manual and it is practically impossible to automate the production of such transformers.

The German model of Utility DE-U No. 8 633 338 describes a transformer for microwave ovens in which the electric windings are formed on carcases made from an insulating material. Such a technique is not sufficient for providing complete insulation of the electric circuit with respect to the magnetic circuit and requires a complementary winding of a ribbon on the electric winding on the carcases. It can be further noted that the magnetic circuit described in this document has a complex shape, with cut outs which reduce the magnetic circuit section in certain zones and disturb the flow of the magnetic flux.

SUMMARY OF THE INVENTION

The purpose of the present invention is more particularly to avoid the drawbacks of known insulating techniques by insulating the magnetic circuits using rigid carcases and covers made from a molded insulating material, having particular shapes adapted more particularly for application to microwave oven transformers, and providing increased electric insulating between the electric circuits themselves and between the electric circuits and the magnetic circuit.

Such an insulating structure in accordance with the invention further makes automatic assembly possible, by means of robust readily handled subassemblies which may themselves be manufactured automatically and be assembled together automatically.

According to another object of the invention this structure reduces the number of parts to be assembled, and the number of parts to be stored.

According to another object, the structure improves the mechanical protection of the windings and thus facilitates handling while avoiding, during such handling, partial damage of the windings and the production of insulating defects. The reliability is thus considerably increased.

The main difficulty when attempting to provide transformer insulation for microwave ovens using rigid molded carcases and covers, is that such an insulating technique leads to substantially increasing the volume of the transformer. The carcase and cover walls must in fact have sufficient thickness to withstand the insulating voltage required and these walls occupy a not inconsiderable volume which becomes proportionally correspondingly higher when the transformer is provided for delivering relatively low power. The result is that this insulating technique using carcases and covers proves at first sight inapplicable to low power microwave oven transformers. The invention solves this problem by reducing the total volume of the electric circuits and their insulation by a partially superimposed arrangement of the windings.

A second problem related to known transformer structures or microwave ovens is the fact that the magnetic shunts, positioned between the primary coil and the secondary coil fulfilling the function of current limiter required for a leak transformer, very often have a poorly defined position, and their electric insulation is difficult to provide.

Another aim of the present invention is then to provide means for positioning the magnetic shunts accurately while repetitively providing an air gap whose dimension is well defined, so as to ensure the repetitivity of calibration of the transformer for mass production. The magnetic shunts are positioned by means of the carcases and covers which simultaneously provide 10 kV dielectric insulation between the windings and the electric shunts as well as the leak line distances required by the safety standards of different countries, by positioning on the central leg of the magnetic circuit and so not haphazardly.

The structure of the invention makes it possible to assemble and fit the shunts and coils in the magnetic circuit automatically or semiautomatically.

The shunts are grounded by contact on the internal part of the external leg of the magnetic circuit, or by an electric ground connection with the shunts and the magnetic circuit. In all cases, the metal plates forming the shunts are immobilized in all directions, so that they cannot vibrate and cause noise.

Once impregnated with varnish, the mass formed by the varnish, the covers and the shunts substantially lowers the sound level of the transformer, which is an additional safety measure for mass production.

A third problem related to known microwave oven structures is the space required by the electric connections of the transformer. Usually, the tags or coil terminals of the low voltage transformers are situated on the rigid carcases or on insulating elements made from bent metal sheets and adapted so as to receive tags. The arrangement of the transformers in microwave enclosures which are more and more compact makes it necessary to place the tags on the visible external face of the coils, that is to say on the periphery face part of the windings which is not covered by the magnetic circuit. In known structures, the tag can therefore no longer be disposed on the carcase and must be held in position by makeshift means such as parts added to the periphery of the windings with interpositioning of insulating elements, the parts for holding the tags in position being held on the windings by adhesive ribbons or other ribbon means. It will be readily understood that these structures cannot be produced by automatic means. Furthermore, they raise problems when soldering external conductors to the tags, such soldering causing local overheating likely to damage the insulating elements and reduce the electric insulation between the tags and the windings. Furthermore, positioning of the tags is not accurate, and the tags do not have a very great tear strength.

The purpose of the present invention is therefore to avoid the drawbacks of known connection means by disposing the electric output tags on the insulating covers covering the carcases. A first advantage of this structure is that the tags disposed on the covers are held away from the windings, without direct contact with the means for electrically insulating the windings. The covers provide additional heat insulation between the tags and the windings so that the tags may be soldered without running the risk of damaging the insulation of the windings. The fact that the tags are held by rigid covers further facilitates the accurate positioning thereof, and makes possible automatic or semiautomatic fitting of the tag on the cover.

The positioning accuracy of the tag and the fact that it is well insulated from the windings makes it possible to solder the tag-output wire by means of an automatic solder bath machine. The positioning accuracy of the tags further facilitates automatic quality control of the coils and transformers leaving the assembly lines.

This arrangement further provides very high tear strength, without the risk of damage and without extra cost, even when the standards to be compiled with are very severe from the tear strength testing point of view, for the tag is adequately and rigidly implanted in the cover.

All these arrangements result in a very substantial gain in productivity and reliability, and an improved appearance, which are not possible with the structure in which the tags are supported by bent and ribbon wound insulating materials.

The cost of producing the transformers is also substantially reduced, since the cutting out and bending operations of a large number of insulating elements is avoided, doing away with all the adhesive ribbons which were necessary in known technologies.

The invention further provides means facilitating the provisional fixing of the coil wires at the end of coiling, these means being formed by studs provided on the carcases and on which the outlet wire is provisionally wound. The wire thus temporarily attached at the end of coiling makes assembly line testing and handling possible without damage.

To attain these objects as well as others, the transformer includes:

a primary carcase made from an insulating material, comprising a central former for the passage of the central magnetic circuit column, and external flange and an internal flange, a secondary carcase made from an insulating material, including a central former for the passage of the central magnetic circuit column, an external flange and an internal flange, two primary insulating covers, each having three walls, covering respectively the external and internal flanges, and the electric winding in the zones facing the magnetic circuit, two secondary insulating covers, each having three walls, covering respectively the external and internal flanges and the electric winding in the zones facing the magnetic circuit, an external annular housing formed in one of the primary or secondary carcase flanges for containing the secondary electric heating winding, thus ensuring its electric insulating and its mechanical securing.

The external annular housing may for example be disposed advantageously on the internal secondary carcase flange, but it will be readily understood that the advantage of a reduction in volume are obtained whatever the carcase flange on which the external annular housing is provided: internal or external secondary or primary carcase flange.

In one embodiment, the external annular housing:

is limited towards the center by an axial mechanical securing flange, has an axial depth only slightly greater than the diameter of the heating winding wire, is closed, on the parts of its periphery surrounded by the magnetic circuit, by corresponding insulating covers covering the carcase, which thus provide the electric insulation between the magnetic circuit and the heating winding.

In a particular embodiment, the external annular housing occupies the part of the flange the closest to the winding axis, the part the furthest away being formed by a shoulder defining an axial cylindrical wall which radially limits the annular housing and which is connected to an axially offset radial wall. Thus, the main carcase winding covers the secondary heating winding externally. The coiling of the winding is thus facilitated.

In all the embodiments, the main carcase winding and the secondary heating winding are partially superimposed and this arrangement substantially reduces the overall volume occupied by the windings.

For positioning the shunts and holding them in position, the inner walls of one of the primary or secondary cover pairs include external housings defined by two lateral flanges in the external limit planes of the magnetic circuit and at least one transverse flange; the housings are intended to contain and to isolate a stack of metal plates forming magnetic shunts, the plates then being separated from the magnetic circuit by an air gap defined by the transverse housing flange.

In a particular embodiment, the housings are provided on the covers of the secondary circuit.

To solve the problem related to the positioning of the electric connection tags and holding them in position, one of the secondary covers has, in its zone not surrounded by the magnetic circuit, an electric connecting tag to which the first end of the secondary high voltage winding wire is connected; similarly, the primary carcase covers include, in their zone not surrounded by the magnetic circuit, tags for connecting the primary winding.

It will be understood that the particular features concerning the construction and position of the housings for holding the magnetic shunts in position, the particular arrangements concerning the positioning of the electric connection tags and holding them in position, the particular arrangements concerning the external flange housings for insertion of the heating winding, may be used either separately or in combination.

BRIEF DESCRIPTION OF THE DRAWINGS

Other objects, features and advantages of the invention will be clear from the following description of particular embodiments, with reference to the accompanying Figs. in which.

DESCRIPTION OF THE PREFERRED EMBODIMENTS

Figure 1:
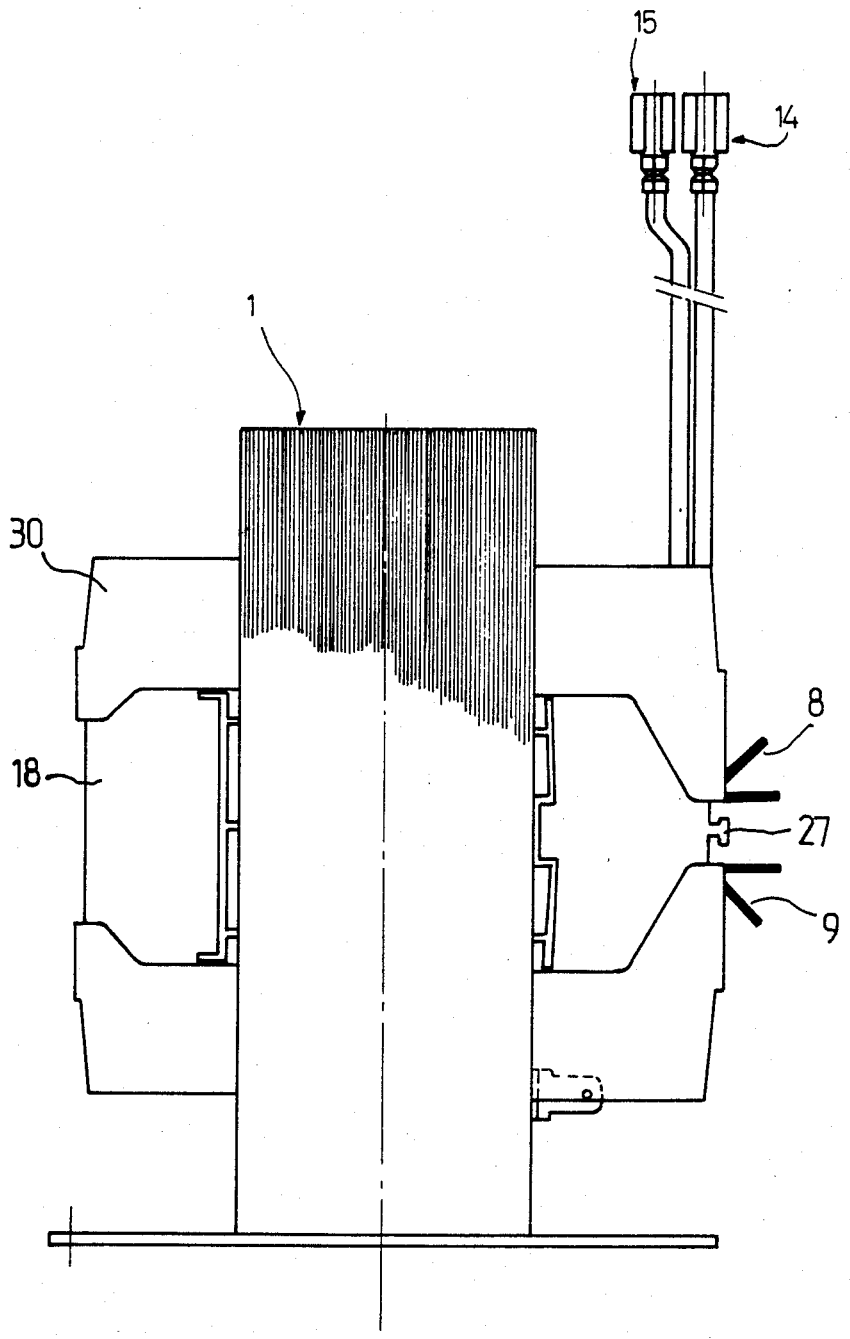
FIG. 1 shows a front view of a transformer of the invention.
Figure 2:
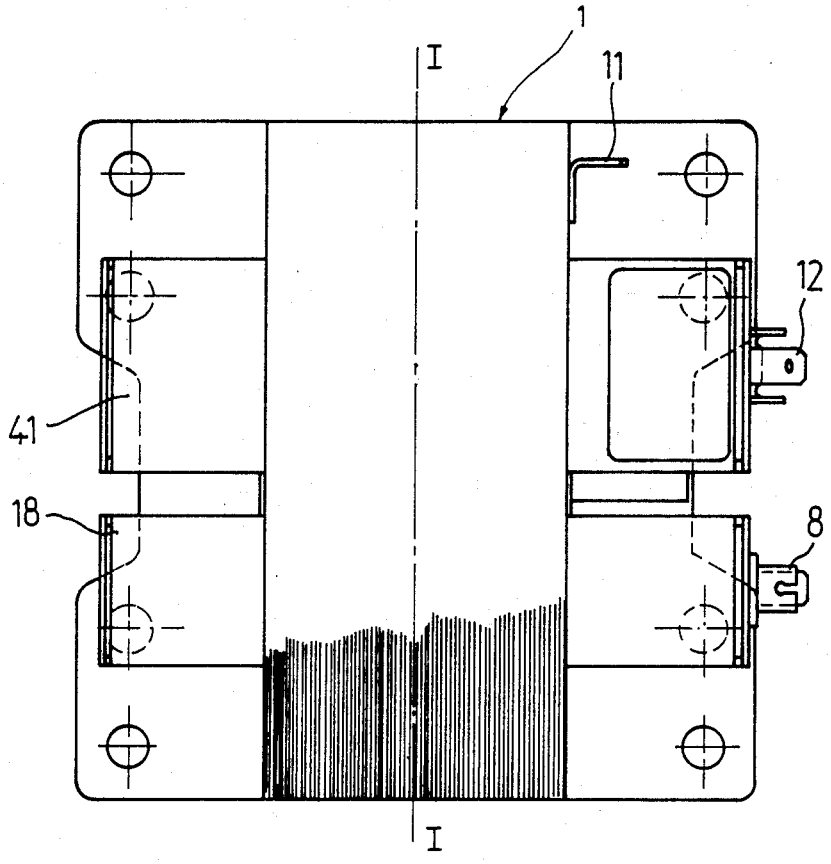
FIG. 2 is a top view of the transformer of FIG. 1.
Figure 3:
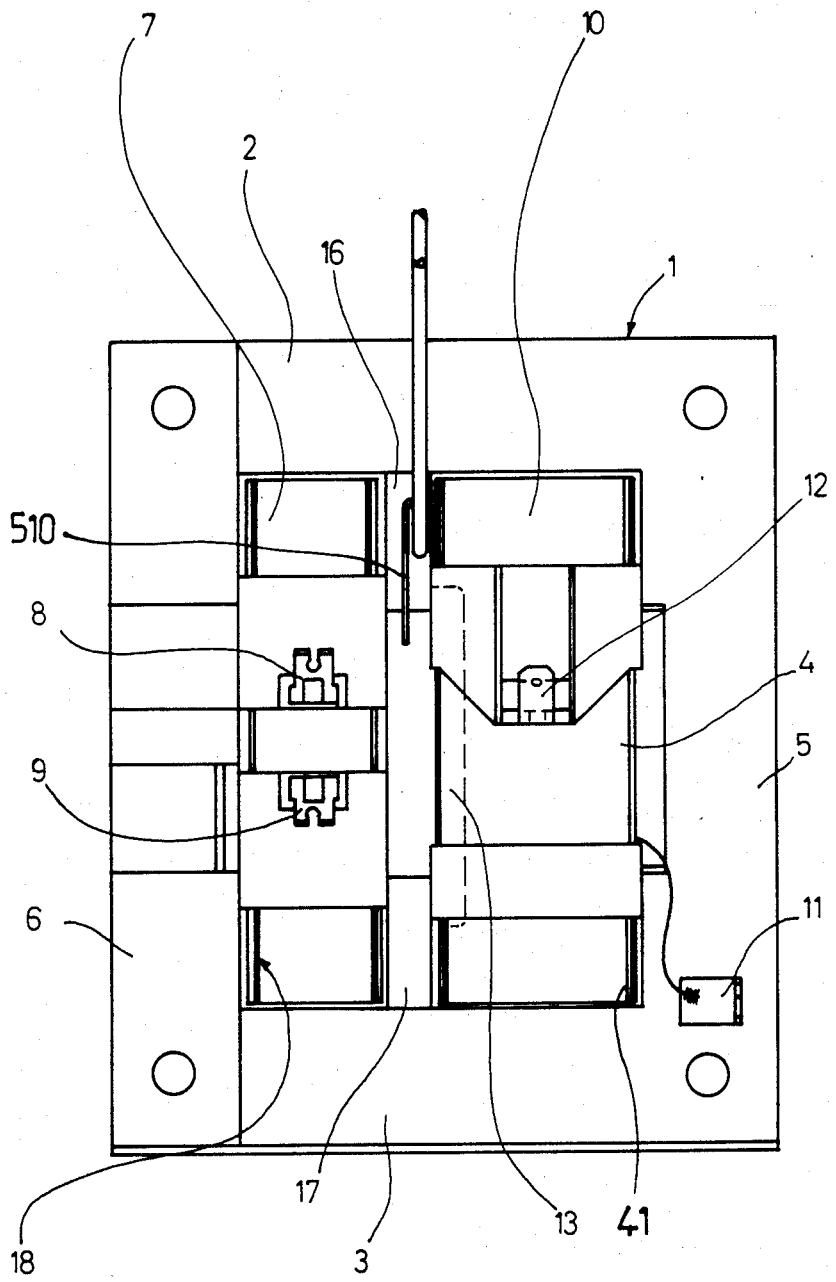
FIG. 3 is a side view of the transformer of FIG. 1.

In FIGS. 1 to 3 can be seen the general construction of a transformer in accordance with the invention. Conventionally, the transformer includes a magnetic circuit 1 with two lateral columns 2 and 3 and a central column 4, the columns being connected together by a first end cross piece 5 and a second end cross piece 6.

In practice, columns 2, 3 and 4 and cross piece 5 are formed by stacking metal sheet plates in the form of an E, and cross piece 6 is formed by a stack of rectangular metal plates fixed to the end of the legs of the E, to which they are welded. The particular structure of electric windings and insulating means of the present invention makes it possible to use magnetic circuits of completely traditional form, in which columns 2, 3 and 4 and cross pieces 5 and 6 have constant appropriate widths for conducting the magnetic flux.

The electric windings of the transformer are disposed about the central column 4 of the magnetic circuit and include a primary electric winding 7 in coil form. The primary winding ends in two primary winding tags 8 and 9 shown in FIG. 3, or two tags 80 and 90 shown in FIG. 6. A secondary high voltage winding 10, also in coil form, ends in two high voltage outlet tags 11 and 12, and a secondary heating winding 13 formed of a few electric conductor turns ending in two heating tags 14 and 15.

Figure 4:
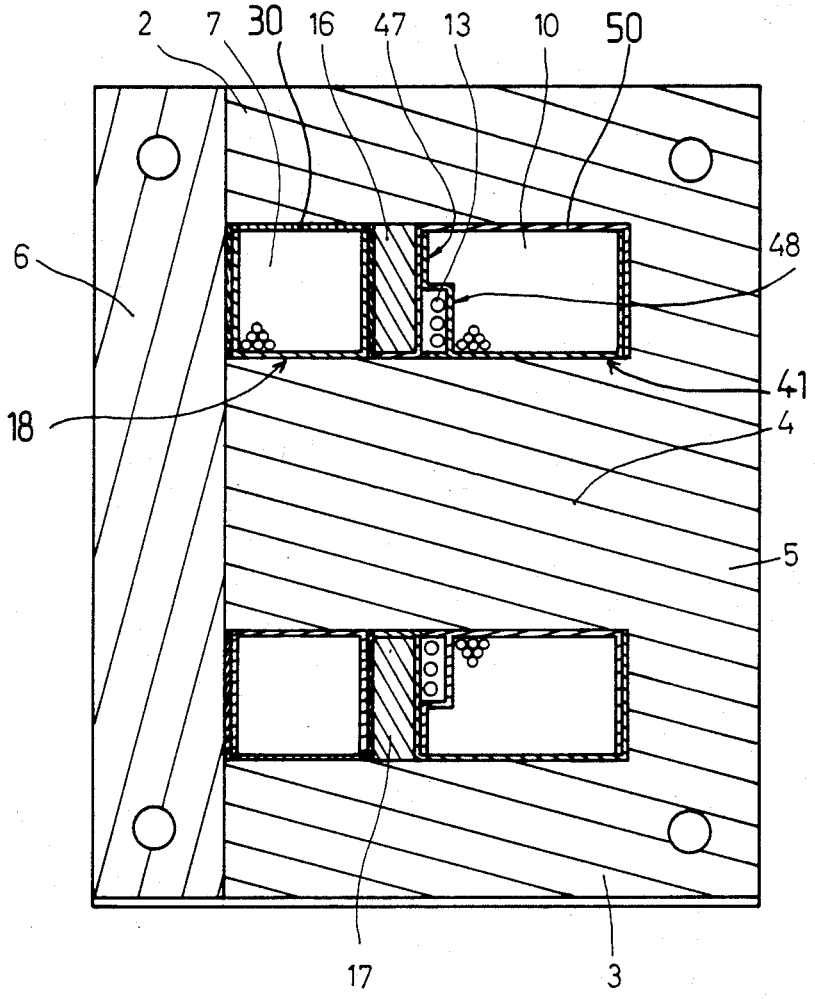
FIG. 4 is a median section side view through the plane I—I of FIG. 2.

A magnetic shunt, formed of two stacks of rectangular plates 16 and 17 shown in FIGS. 3 and 4, connects together the intermediate parts of the lateral columns and of the central column of the magnetic circuit, in the zone situated between the primary winding 7 and the secondary windings 10 and 13.

The electric windings are coiled on carcases made from an electrically insulating material, receiveing appropriately shaped covers also made from an electrically insulating material.

Figure 6:
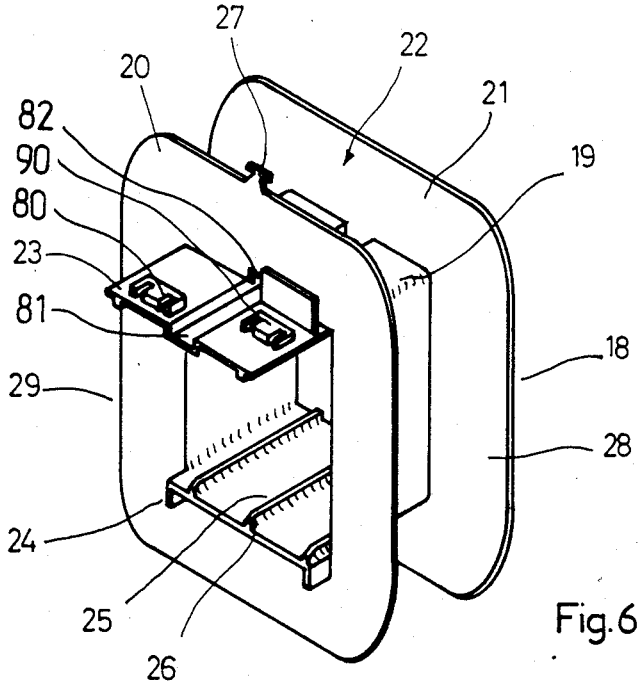
FIG. 6 is a perspective view of a primary carcase of a transformer of the invention.

As shown in FIG. 6, the primary carcase 18 includes a tubular shaped central mandrel 19 adapted for fitting about the central column 4 of the magnetic circuit. The central former ends in an external flange 20 and an internal flange 21, the assembly defining a peripheral annular groove 22 in which the primary electric coil 7 is wound. The internal flange 20 is intended to be disposed outwardly of the transformer, namely on the side opposite the secondary carcase, whereas the internal flange 21 is intended to be facing the secondary carcase.

The vertical parts 28 and 29 of the primary carcase shown in FIG. 6 are intended to be surrounded by the magnetic circuit of the transformer. The corresponding vertical internal walls of former 19 are smooth, as shown in the Fig., and receive with a loose fit the edge of the plates of the central column 4 of the magnetic circuit. The horizontal walls of the former are extended outwardly by flanges 23 and 24, flange 23 being shaped so as to receive tags 80 and 90 for the electric connection of the primary winding. Flange 23 further includes an external axial groove 81 communicating with the annular peripheral groove 22 through an aperture 82, groove 81 extending over the former 19. Groove 81 is intended to receive axially a safety member responsive to the temperature of the primary winding and the intensity of the current which flows therethrough. With this arrangement, the safety member is in the immediate vicinity of the winding, even in direct contact with the first turns, thus improving the tripping speed. The inner faces of flanges 23 and 24 as well as the inner horizontal faces of the former include longitudinal ribs such as rib 25. Ribs 25 are chamfered at the ends, for example the chamfer 26, for facilitating fitting of the carcases on the magnetic circuit. Ribs 25 define the bearing surface for the central column 4 of the magnetic circuit and make it possible to provide rounded corners on the former 19, for fitting to a column 4 with rectangular section and sharp edges.

The external flange 20, in its horizontal upper portion, has a stud 27 for temporarily fixing the end of the electric winding during coiling, before the end of the conductor is fixed to tag disposed on flange 23, or preferably on one of the primary insulating covers.

Figure 8:
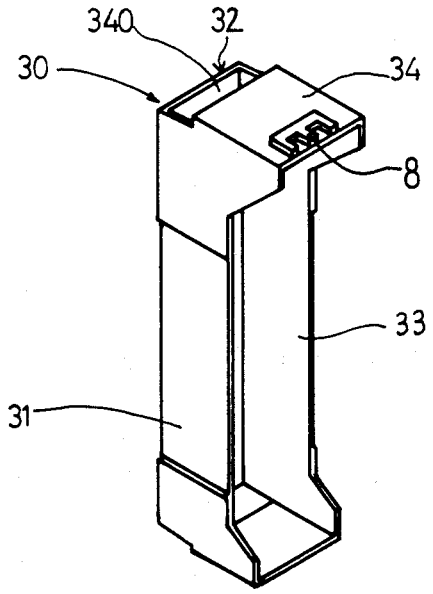
FIG. 8 is a perspective view of a primary insulating cover of the invention.

The vertical parts 28 and 29 of the primary carcase are intended to be covered by primary insulating covers such as cover 30 shown in FIG. 8. Cover 30 includes three main walls 31, 32 and 33, the parallel walls 31 and 33 being provided for partially covering the flanges of the primary carcase, wall 32 being provided for partially covering the primary electric winding. It will be readily understood that the assembly formed by a cover 30, former 19 and the vertical carcase parts 28 defines an insulating case surrounded by the magnetic circuit and providing electric insulation between this magnetic circuit and the electric coil wound on the carcase.

The ends of walls 31 and 33 are connected together by bands such as band 34, having means for fixing an electric tag, and simultaneously giving rigidity to cover 30. An opening 340 is left between each band 34 and wall 32 so that varnish may flow therein during impregnation of the coil.

The primary carcase covers include, in their zone not surrounded by the magnetic circuit, tags 8 and 9 for primary winding connection.

Figure 5:
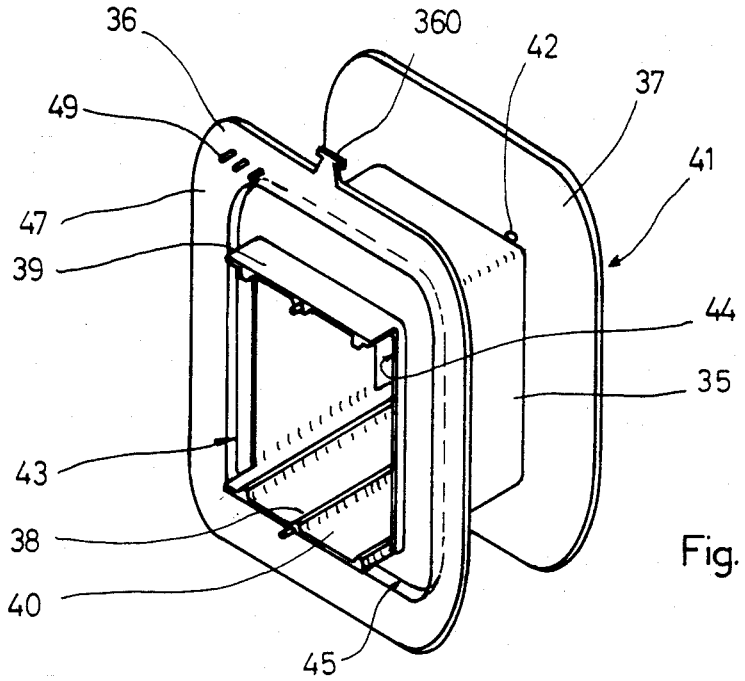
FIG. 5 is a perspective view of the secondary carcase of a transformer of the invention.

Similarly, the secondary carcase 41, shown in FIG. 5, has a central former 35, an internal flange 36 and an external flange 37. The horizontal inner faces of former 35 are provided with ribs such as the longitudinal rib 38. Two flanges 39 and 40 extend the horizontal walls of the former 35 beyond the internal flange 36. These flanges 39 and 40 are shaped so as to have the same length as the dimension of the magnetic shunt and bear against the internal flange of the primary carcase.

The base of the external flange 37 of the secondary carcase 41 has a hole 42 for passing therethrough a first end of the secondary high voltage winding, this first end being connected to the high voltage tag 11 fixed to the magnetic circuit and connected to the electric ground of the microwave oven.

In the embodiment shown in the Figs., the internal flange 36 of the secondary carcase 41 has a particular shape, as can be seen in FIGS. 5 and 4, and includes an external annular housing 43 intended to contain the secondary electric heating winding 13. The external annular housing 43 is defined toward the center of the carcase by an axial peripheral flange 44. The housing has an axial depth only slightly greater than the diameter of the heating coil wire 13. Its periphery is defined by a shoulder 45 forming a cylindrical wall defining the annular housing radially and connected to an external part of the flange 36. In other words, flange 36 is formed of an external radial wall 47, connected by shoulder 45 to an internal part 48, the internal part 48 being offset axially inwardly of the carcase with respect to the external radial wall 47, so as to leave room for housing 43. In the end zone of the winding, namely in the left hand part of the secondary carcase shown in FIG. 4 it can be seen that the secondary high voltage winding 10 covers the secondary heating winding 13.

Figure 7:
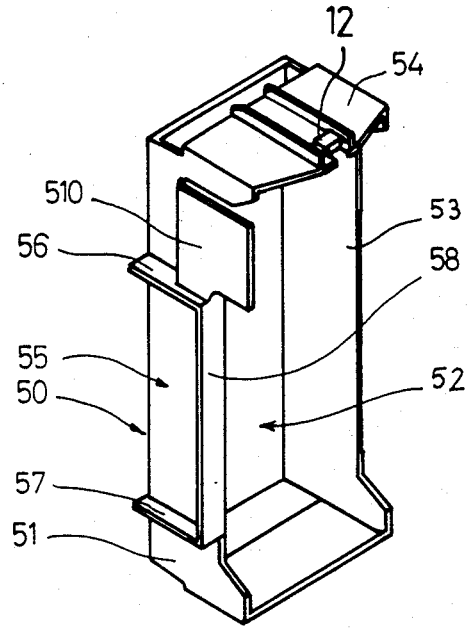
FIG. 7 is a perspective view of a secondary insulating cover of the invention.

The secondary carcase 41 is adapted for receiving secondary insulating covers such as cover 50 shown in FIG. 7. Similarly to the primary winding carcase, the secondary carcase 41 receives two covers such as cover 50, covering its vertical parts shown in FIG. 5. Cover 50 has a shape similar to that of cover 30 and has three main walls 51, 52 and 53. A band 54, connecting together the ends of walls 51 and 53 in the zone not surrounded by the magnetic circuit, receives an electric connection tag 12 to which is connected the second end of the electric conductor of the secondary high voltage winding 10.

The internal flange 36 further has on its external face studs 49 provided for cooperating with a facet 510 of the corresponding wall 51 of the insulating cover 50 so as to define means for holding the outputs of the secondary electric heating winding in position.

Wall 51, or internal wall of cover 52, comprises an external housing 55 defined by two lateral flanges 56 and 57 in the external limit planes of the magnetic circuit and a transverse flange 58 in the plane of a vertical wall of the central carcase former 35. Housing 55 is provided for containing and insulating a stack of metal plates forming the magnetic shunt 16 or 17. The plates are in contact with one of the lateral columns of the magnetic circuit and are separated from the central column 4 by an air gap defined by the transverse flange 58 of the housing.

In the preceding embodiment, since the metal plates are in contact with one of the lateral columns of the magnetic circuit, the shunts are grounded by contact with the main magnetic circuit. In another embodiment, external housings 55 may be provided also defined by two lateral flanges 56 and 57 in the external limit planes of the magnetic circuit, a first transverse flange 58 in the plane of a vertical wall of the central carcase former 35 and a further second transverse flange, not shown in the Figs., along the lateral leg of the magnetic circuit. In this case, the external housing 55 is a bath closed on four sides, and the air gap is defined by the sum of the thicknesses of the two transverse flanges. It is then necessary to provide an electric ground connection between the shunts and the magnetic circuit.

In the embodiment shown, housings 55 are disposed on the secondary insulating covers. In another embodiment, housings 55 are disposed on the primary insulating covers. The arrangements shown in the Figs. may however be preferred since it facilitates automatic assembly of the unit: it is in fact preferable to assemble first of all, on the magnetic circuit, the secondary windings then the primary winding; it will be readily understood then that, using this method of assembly, the stack of shunt plates may be simply laid in housings 55, in which the plates are held in position by gravity.

Covers 50, when they are fitted to the secondary carcase 41, partially close housing 43 and provide the mechanical fixing and electric insulation of the secondary heating winding 13.

The secondary carcase has, on the external edge of one of its flanges, a radial stud 360 on which the first end of the secondary high voltage winding wire may be temporarily wound before connection to the outlet tag, the other end of the winding wire leaving the carcase through the radial hole 42 close to the central tunnel and connected to the magnetic circuit.

With such a structure, it will be readily understood that it is possible to form the primary windings and the secondary windings separately each on their respective carcases, then the insulating covers may be fitted for defining independent subassemblies which may be handled without damage to the electric windings. The secondary winding is stacked on the magnetic circuit, then the magnetic shunts are placed in their housings 55 and finally the primary winding, then cross piece 6.

The present invention is not limited to the embodiments which have been more explicitly described, but includes, the different variants and generalizations thereof contained within the scope of the following claims.

What is claimed is:

1. In a transformer for microwave ovens including:

a main primary electric winding, in the form of a coil, a main secondary high electric voltage winding in coil form, a secondary electric heating winding in coil form, a magnetic circuit with two lateral columns and a central column all three connected together by end cross pieces and by an intermediate magnetic shunt, the electric windings being disposed about the central column, the magnetic shunt being disposed between the primary winding and the secondary high voltage winding, electric insulating means between the primary and secondary windings and between the electric windings and the magnetic circuit, electric connection means for connecting the ends of the electric windings to external electric circuits.

a primary carcase made from an insulating material, comprising a central former for the passage of the central magnetic circuit column, and an external flange and an internal flange, a secondary carcase made from an insulating material, including a central former for the passage of the central magnetic circuit column, an external flange and an internal flange, said insulating means include:

two primary insulating covers, each having three walls, covering respectively the external and internal flanges, and the electric winding in the zones facing the magnetic circuit, two secondary insulating covers, each having three walls, covering respectively the external and internal flanges and the electric winding in the zones facing the magnetic circuit, an external annular housing formed in one of the internal flanges and containing the secondary electric heating winding, thus ensuring its electric insulation and its mechanical securing.

2. The transformer for microwave ovens as claimed in claim 1, wherein said external housing:

is limited toward the center by an axial mechanical securing flange, has an axial depth only slightly greater than the diameter of the heating winding wire, is closed, on the parts of its periphery surrounded by the magnetic circuit, by corresponding insulating covers covering the carcase, which thus provide the electric insulation between the magnetic circuit and the heating winding.

3. The transformer for microwave ovens as claimed in claim 2, wherein the external annular housing occupies the part of the flange the closest to the winding axis, the part of the furthest away being formed by a shoulder defining an axial cylindrical wall which radially limit the annular housing and which is connected to an axially offset radial wall so that the main carcase winding covers the secondary heating winding externally.

4. The transformer for microwave ovens as claimed in claim 1, wherein said external annular housing is formed on the internal flange of the secondary carcase.

5. The transformer for microwave ovens as claimed in claim 4, including studs projecting axially from the inner flange of the secondary carcase in a zone facing an insulating cover wall, and cooperating with a facet of the corresponding wall of the insulating cover so as to hold the wires extending out of the secondary heating winding mechanically in position.

6. The transformer for microwave ovens as claimed in claim 1, wherein one at least of the carcases has, on the external edge of one of its flanges, a radial stud on which the first end of the main carcase winding wire can be temporarily wound before connection to the outlet tag, the other end of the winding wire leaving the carcase through a radial hole close to the central tunnel.

7. The transformer for microwave ovens as claimed in claim 1, wherein the internal walls of one of the primary or secondary cover pairs include external housings defined by two lateral flanges in the external limit planes of the magnetic circuit and at least one transverse flange, the housings containing and insulating a stack of metal plates forming the magnetic shunt, the plates being separated from the magnetic circuit by an air gap defined by the transverse housing flange.

8. The transformer for microwave ovens as claimed in claim 7, wherein the housings are provided in the covers of the main secondary winding.

9. The transformer for microwave ovens as claimed in claim 1, wherein one of the secondary covers has, in its zone not surrounded by the magnetic circuit, an electric connection tag to which the first end of the secondary high voltage winding wire is connected.

10. The transformer for microwave ovens as claimed in claim 1, wherein the primary carcase covers include, in their zone not surrounded by the magnetic circuit, primary winding connection tags.

* * * * *